US008596719B2

(12) United States Patent
Engman et al.

(10) Patent No.: US 8,596,719 B2
(45) Date of Patent: Dec. 3, 2013

(54) WHEELCHAIR BACKREST ASSEMBLY

(75) Inventors: Bo Engman, Sundsvall (SE); Urban Lind, Alno (SE); Niklas Backstrom, Sundsvall (SE); Jonas Jahkel, Hagersten (SE); Mehdi Mirzaie, Brentwood, TN (US)

(73) Assignee: Permobil AB, Timra (SE)

( * ) Notice: Subject to any disclaimer, the term of this patent is extended or adjusted under 35 U.S.C. 154(b) by 476 days.

(21) Appl. No.: 12/896,078

(22) Filed: Oct. 1, 2010

(65) Prior Publication Data

US 2012/0080919 A1 Apr. 5, 2012

(51) Int. Cl.
*A47C 1/00* (2006.01)

(52) U.S. Cl.
USPC ..... 297/343; 297/340; 297/341; 297/354.13

(58) Field of Classification Search
USPC ..... 297/316–318, 340–341, 343, DIG. 4, 297/354.13, 284.7, 230.14, 230.13
See application file for complete search history.

(56) References Cited

U.S. PATENT DOCUMENTS

| | | | | |
|---|---|---|---|---|
| 3,640,571 | A | 2/1972 | Keropian | |
| 3,641,995 | A | 2/1972 | Brandt | |
| 4,362,336 | A | 12/1982 | Zapf et al. | |
| 4,502,729 | A | 3/1985 | Locher | |
| 4,655,471 | A * | 4/1987 | Peek | 280/250.1 |
| 5,524,969 | A | 6/1996 | Harrison et al. | |
| 5,549,357 | A | 8/1996 | Counts et al. | |
| 5,556,168 | A | 9/1996 | Dinsmoor, III et al. | |
| 5,749,627 | A | 5/1998 | Perego | |
| 5,823,621 | A * | 10/1998 | Broadhead | 297/354.13 |
| 5,906,416 | A | 5/1999 | Rasmussen | |
| 6,158,810 | A * | 12/2000 | Galloway | 297/354.1 |
| 6,390,554 | B1 | 5/2002 | Eakins et al. | |
| 6,409,265 | B1 | 6/2002 | Koerlin et al. | |
| 6,425,635 | B1 | 7/2002 | Pulver | |
| 6,439,531 | B1 | 8/2002 | Severini et al. | |
| 6,557,939 | B1 | 5/2003 | Brauning | |
| 6,607,250 | B2 | 8/2003 | Papac | |

(Continued)

FOREIGN PATENT DOCUMENTS

| | | | |
|---|---|---|---|
| WO | WO 01/32120 | A1 | 5/2001 |
| WO | WO 2006/047341 | A2 | 5/2006 |
| WO | 2012170863 | A2 | 12/2012 |

OTHER PUBLICATIONS

Patent Cooperation Treaty, Notification of Transmittal of the International Search Report and the Written Opinion of the International Searching Authority, in International application No. PCT/US2011/054255, dated Dec. 22, 2011 (12 pages).

(Continued)

*Primary Examiner* — Sarah B McPartlin
*Assistant Examiner* — Erika Garrett
(74) *Attorney, Agent, or Firm* — McAndrews, Held & Malloy, Ltd.

(57) ABSTRACT

A backrest assembly for a wheelchair includes a support plate pivotally connected to a seat, wherein the support plate is configured to be pivotally adjusted between upright and reclined positions with respect to the seat; a slide plate slidably secured on a front surface of the support plate; and a backrest adjustment assembly operatively connected to the support plate and the slide plate. The backrest adjustment assembly includes a link configured to adjust the support plate. The slide plate slides over the support plate through the link.

14 Claims, 4 Drawing Sheets

(56) References Cited

U.S. PATENT DOCUMENTS

| | | | | |
|---|---|---|---|---|
| 6,659,563 | B2 | 12/2003 | Float et al. | |
| 6,688,693 | B2 * | 2/2004 | Christofferson et al. | 297/354.12 |
| 6,976,699 | B2 | 12/2005 | Koerlin | |
| 7,104,610 | B2 * | 9/2006 | Cramer | 297/440.2 |
| 7,490,904 | B2 * | 2/2009 | Hogg | 297/343 |
| 7,740,315 | B2 | 6/2010 | Ball et al. | |
| 7,832,744 | B2 | 11/2010 | Chen et al. | |
| 7,891,695 | B2 * | 2/2011 | Perk | 280/647 |
| 8,197,009 | B2 * | 6/2012 | Whelan et al. | 297/440.2 |
| 2005/0029855 | A1 | 2/2005 | Hanson et al. | |
| 2006/0091706 | A1 * | 5/2006 | Christofferson et al. | 297/130 |
| 2007/0170761 | A1 | 7/2007 | Whelan et al. | |
| 2009/0163841 | A1 | 6/2009 | Garth | |
| 2011/0193387 | A1 | 8/2011 | Kim | |

OTHER PUBLICATIONS

Patent Cooperation Treaty, Notification of Transmittal of the International Preliminary Report on Patentabiity, in International application No. PCT/US2011/054255, dated Apr. 11, 2013. (9 pages).

Permobil, Corpus II Owner's Manual, Edition No. 1, published May 1999.

Permobil, Corpus II Owner's Manual, Edition No. 3, published Dec. 2004.

Permobil, Corpus II (incl. Seat Elevators) Spare Parts Catalog, published May 1995.

Excerpt from Corpus II Spare Parts Catalog, Ergonomic Backrest Kits, updated Aug. 23, 2010.

Excerpt from Corpus II Spare Parts Catalog, Seat Frame, updated Aug. 23, 2010.

Quickie S-646 Parts Manual, Sunrise Medical Inc., May 2013.

* cited by examiner

WHEELCHAIR BACKREST ASSEMBLY

FIELD OF EMBODIMENTS OF THE INVENTION

Embodiments of the present invention generally relate to wheelchairs, and, more particularly, to backrest assemblies for wheelchairs.

BACKGROUND

Power wheelchairs are used by disabled individuals in order to move around in comfort and relative ease. Indeed, these wheelchairs have improved throughout the years to provide numerous features that provide additional comfort to individuals.

A power wheelchair typically includes a base having wheels. The base supports a seat assembly. The seat assembly typically includes a seating area and a backrest. The individual controls operation of the wheelchair through a control interface, such as a joystick, typically positioned on an armrest of the seat assembly. The control interface is in electrical communication with a processing system that is also connected to motors that drive the wheels, a steering mechanism, and the like. The processing system generally controls overall operation of all powered aspects of the wheelchair.

An individual may adjust the backrest for comfort. For example, the backrest may be pivoted back to provide a reclined back support.

FIG. 1 illustrates an isometric side view of a conventional wheelchair 10. The wheelchair 10 includes a backrest 12. The backrest 12 is adjusted through a backrest adjustment assembly 14 positioned behind the backrest 12. The backrest adjustment assembly 14 is operable to pivot the backrest 12 by pivoting the backrest 12 about two pivot hinges 16 on either side of the backrest 12 proximate the seat 18.

Additionally, with respect to many wheelchairs, the backrest adjustment assembly may be bulky and obtrusive. Further, pivot hinges on the sides of certain backrests may contact an individual within a seat when the backrests are reclined. As such, an individual may experience discomfort while seated. Further, the individual may find that the pivot hinges may impede the individual while trying to unseat his/herself. That is, when the backrest is reclined, the pivot hinges may come into contact with an individual's elbows.

Additionally, certain types of pivot hinges tend to bind up at times due to the location of the pivot hinges at a lower portion of backrest near the seat. Thus, adjustment of the backrest may be uneven and halting.

SUMMARY OF EMBODIMENTS OF THE INVENTION

Certain embodiments of the present invention provide a backrest assembly for a wheelchair. The backrest assembly includes a support plate pivotally connected to a seat. The support plate is configured to be pivotally adjusted between upright and reclined positions with respect to the seat. The assembly also includes a slide plate slidably secured on a front surface of the support plate, and a backrest adjustment assembly. The backrest adjustment assembly includes an actuator configured to pivotally adjust the backrest and a link configured to adjust the slide plate with respect to the support plate.

In the reclined position, the slide plate is slid down the support plate. A cushion is secured to a front of the slide plate.

The support plate is a unitary piece integrally formed from a single piece of material. For example, the support plate may be a single piece of extruded aluminum.

The link may connect to a drive bar on a rear surface of the support plate. In turn, the drive bar may operatively connect to a pivot arm on the front surface of the support plate. Additionally, the pivot arm may operatively connect to the slide plate. Movement of the pivot arm causes the slide plate to slide over the slide plate.

The backrest adjustment assembly may be positioned below the support plate.

Certain embodiments of the present invention provide a power wheelchair that includes a support base having wheels, a seat supported by the support base, and a backrest assembly configured to pivot between upright and reclined positions with respect to the seat. The backrest assembly may be similar to the embodiments described above.

Figure 1:
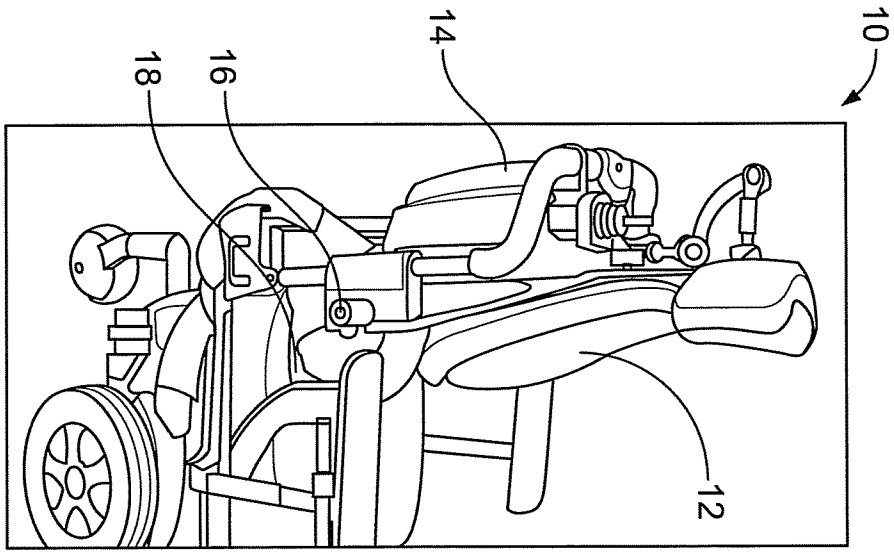
FIG. 1 Prior Art
FIG. 1 illustrates an isometric side view of a conventional wheelchair.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof.

DETAILED DESCRIPTION OF EMBODIMENTS OF THE INVENTION

Figure 2:
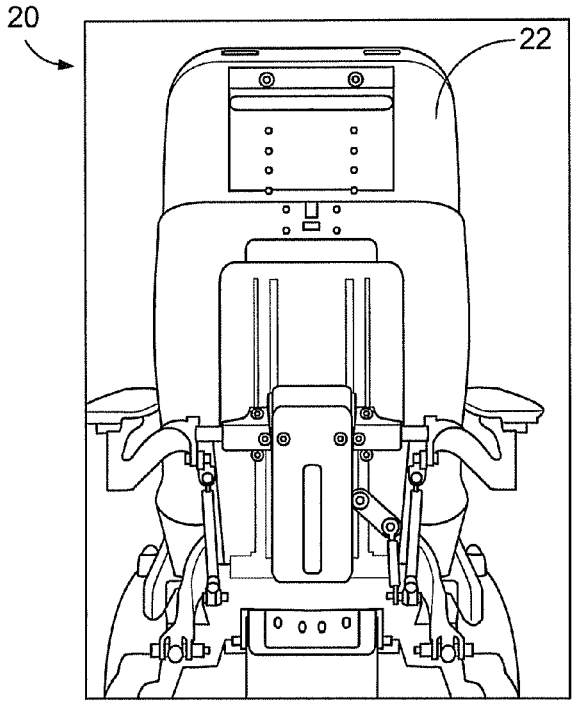
FIG. 2 illustrates a rear view of a powered wheelchair, according to an embodiment of the present invention.

FIG. 2 illustrates a rear view of a powered wheelchair 20, according to an embodiment of the present invention. The wheelchair 20 includes a backrest 22 and a backrest adjustment assembly operatively connected to the backrest 22. The backrest adjustment assembly may include an actuator (not shown) operatively connected to the backrest 22 through a mechanical link, such a as an arm, beam, or the like. In this manner, the actuator may adjust the backrest 22 between upright and reclined positions.

Unlike the wheelchair 10 shown in FIG. 1, the backrest adjustment assembly is positioned below and behind the backrest 22. Moreover, the backrest adjustment assembly is small and compact in comparison to the backrest adjustment assembly 14 of the wheelchair 10 (shown in FIG. 1).

Figure 3:
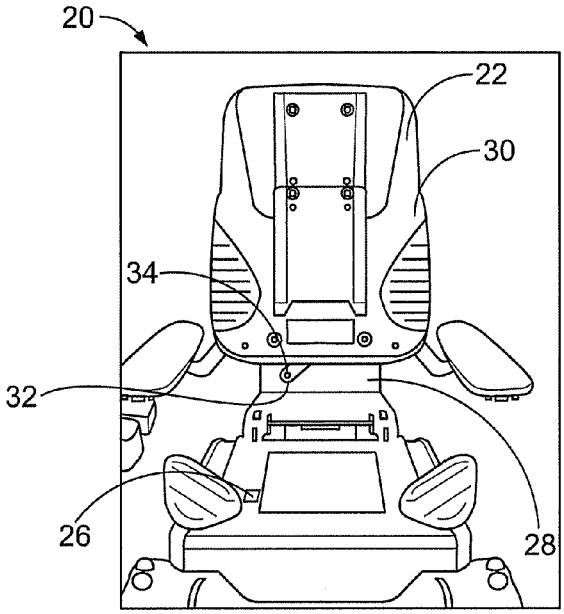
FIG. 3 illustrates a front view of a powered wheelchair, according to an embodiment of the present invention.

FIG. 3 illustrates a front view of the powered wheelchair 20. The backrest 22 is adjustably connected to a seating area 26. The backrest 22 includes a backrest support plate 28. A cushion 30 secures over an upper portion of the support plate 28. As shown in FIG. 3, a pivot arm 32 is rotatably secured on the support plate 28. While one end of the pivot arm 32 is exposed, the other end of the pivot arm 32 is underneath the cushion 30. The pivot arm 32 connects to the support plate 28 by way of a pivot stud 34 that allows the pivot arm 32 to rotate about a central axis of the stud 34 in a plane that is parallel to the main outer surface of the support plate 28.

Figure 4:
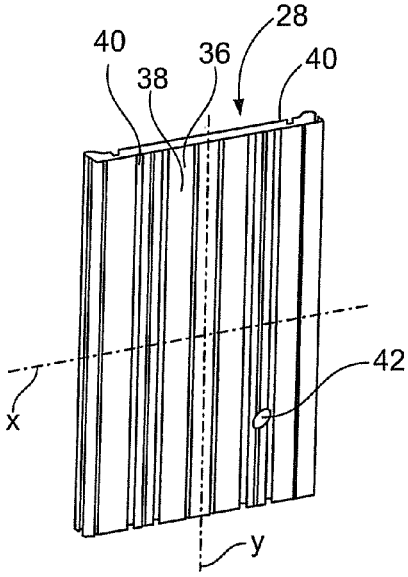
FIG. 4 illustrates an isometric front view of a backrest support plate, according to an embodiment of the present invention.

FIG. 4 illustrates an isometric front view of the backrest support plate 28, according to an embodiment of the present invention. The backrest support plate 28 is integrally formed from a single piece of material, such as aluminum. The backrest support plate 28 includes a main body 36 having a main outer surface 38 that is generally flat. Longitudinal grooves 40 are formed over a length of the outer surface 38.

A circular channel 42 is formed through the main body 36. The channel 42 is formed below a horizontal axis x of the main body 36 and is offset from a vertical axis y.

Figure 5:
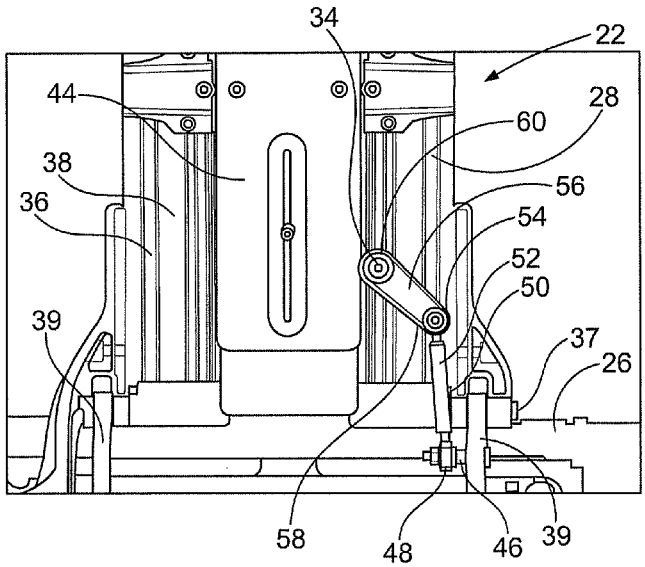
FIG. 5 illustrates a rear view of a backrest, according to an embodiment of the present invention.

FIG. 5 illustrates a rear view of the backrest 22, according to an embodiment of the present invention. The backrest 22 is pivotally secured to the seating area 26 through an axle 37 that is rotatably secured to the seating area 26 through brackets 39. As noted above, an actuator (not shown) is configured to pivotally adjust the backrest 22 with respect to the seating area 26 about the axle 37.

A cover 44 may also be secured to the axle and securely fixed to the support plate 28. As shown, the cover 44 is not as wide as the support plate 28. The cover 44 may be a plastic cover that protects electronics, mechanical linkages, and the like.

A post 46 extends from a lower end of one of the brackets 39. The post 46 is parallel with the axle 37. A link 48 is rotatably secured to the post 46. The link 48 may be a rigid bar having a fixed length. The link 48 maintains a constant distance between its attachment to the post 46 and a drive bar 56.

The link 48 includes a main body 50 with a post pivot 52 and a bar pivot 54 at opposite ends. The post pivot 52 may include a circular opening that is secured around the post 46. Optionally, the post pivot 52 may be integrally formed with the post 46.

The bar pivot 54 pivotally secures to an end of the drive bar 56. As shown in FIG. 5, the bar pivot 54 pivotally connects to the end of the drive bar 56 parallel to the main outer surface 38 of the main body 36.

The drive bar 56 includes a lower end 58 that rotatably connects to the bar pivot 54 of the link 48. The drive bar 56 also includes an upper end 60 that pivotally connects to the pivot stud 34, which is received and pivotally retained within the channel 42. The pivot stud 34 extends through the main body 36 of the support plate 28 to the other side, where it is secured to the pivot arm 32 (shown in FIG. 3, for example).

As noted above, an actuator (not shown) is attached to an arm operatively connected to the backrest 22. The actuator causes the backrest 22 to adjust between reclined and upright positions.

As the backrest 22 reclines, the drive bar 56 rotates around the pivot stud 34 to maintain the fixed distance defined by the link 48.

Figure 6:
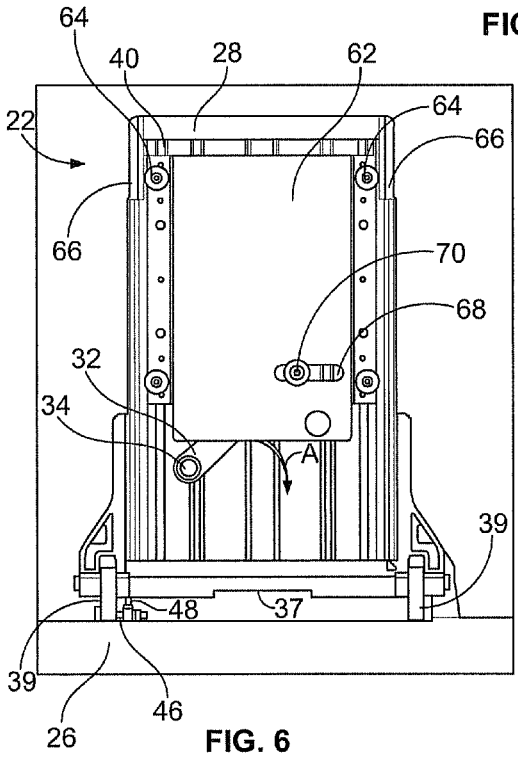
FIG. 6 illustrates a front view of a backrest, according to an embodiment of the present invention.

FIG. 6 illustrates a front view of the backrest 22. The slide plate 62 is slidably secured on the front surface of the support plate 28. The slide plate 62 includes ridges (not shown) that are slidably received and retained within grooves 40 of the support plate 28. Additionally, bearing wheels 64 may be positioned on either side of the slide plate 62 and configured to engage inner lateral surfaces of crimped lateral edges 66 of the support plate 28.

A horizontal slot 68 is formed through the slide plate 62. A bearing wheel or knob 70 extending from the pivot arm 32 opposite the end that retains the pivot stud 34 is rotatably or slidably retained within the slot 68.

The pivot arm 32 is rigidly connected to the pivot stud 34. The pivot arm 32 rotates in response to rotation of the pivot stud 34. In response to the rotation of the pivot arm 32, the slide plate 62 slides along the support plate 28, as explained below.

Figure 7:
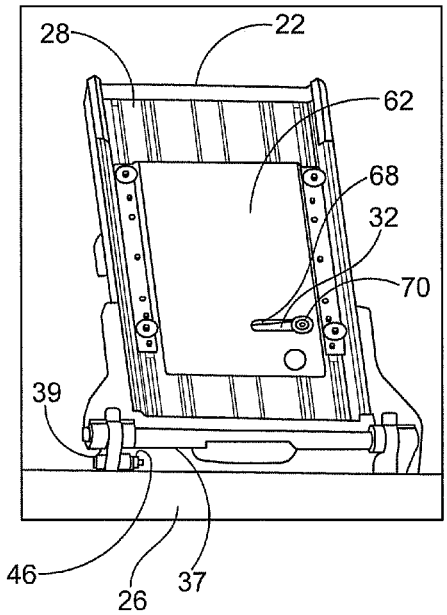
FIG. 7 illustrates an isometric front view of a backrest, according to an embodiment of the present invention.

FIG. 7 illustrates an isometric front view of the backrest 22. Referring to FIGS. 6 and 7, as the backrest 22 reclines, the pivot arm 32 swings down about the axis of the pivot stud 34 in the direction of arc A. As such, the pivot arm 32 moves to a level orientation with respect to the support plate 28. The knob 70 slides through the slot 68, causing the slide plate 62 to slide down the support plate 28. When the backrest 22 is moved back to an upright position, the movements described with respect to FIGS. 6 and 7 are reversed.

Figure 8:
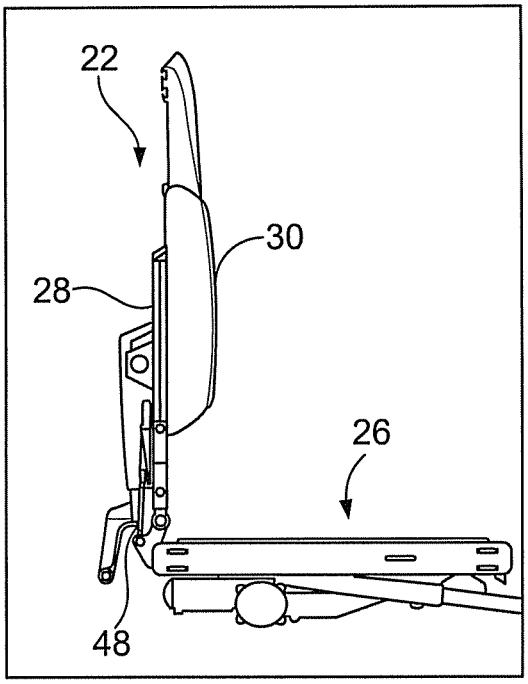
FIG. 8 illustrates a side view of a backrest in an upright position, according to an embodiment of the present invention.

FIG. 8 illustrates a side view of the backrest 22 in an upright position, according to an embodiment of the present invention. The cushion 30 is secured to the slide plate 62 (shown in FIGS. 6 and 7).

Figure 9:
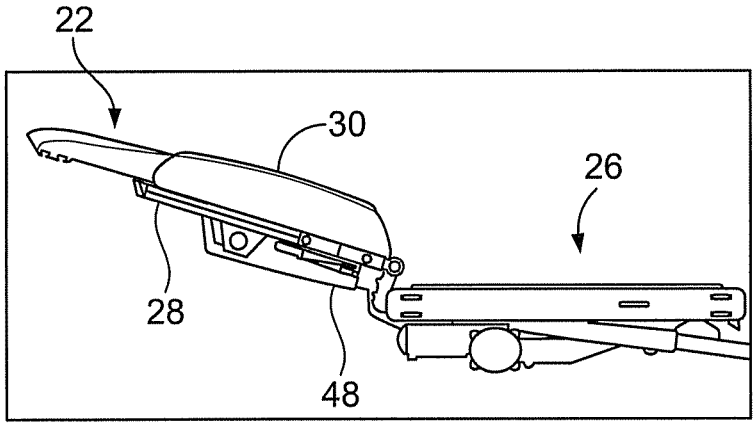
FIG. 9 illustrates a side view of a backrest in a reclined position, according to an embodiment of the present invention.

FIG. 9 illustrates a side view of the backrest 22 in a reclined position, according to an embodiment of the present invention. As shown, when the backrest 22 is reclined, the cushion 30 moves down toward the base of the backrest 22, due to the movement of the slide plate 62 (shown in FIGS. 6 and 7) noted above. Therefore, in the reclined position, an individual seated in the seating area 26 does not experience any cushioning gaps with respect to the lower back.

Moreover, as shown in FIGS. 3-9, the wheelchair does not include any pivoting hinges that interfere with armrests or that hinder an individual seated in the wheelchair. Instead, the pivot arm 32 is positioned on the support plate 28 itself, and is covered by the slide plate 62 and the cushion 30 when in a reclined position.

Further, embodiments of the present invention provide a system and method for backrest adjustment that is simple and easy to operate. Embodiments of the present invention provide a system for backrest adjustment that is not bulky and obtrusive, such as the wheelchair 10 (shown in FIG. 1).

It has been found that embodiments of the present invention provide a system and method of adjusting a backrest of a power wheelchair that is smooth and even. Further, unlike certain prior wheelchairs, the adjusting mechanisms are less susceptible to binding and malfunctioning.

While various spatial and directional terms, such as top, bottom, lower, mid, lateral, horizontal, vertical, front and the like may used to describe embodiments of the present invention, it is understood that such terms are merely used with respect to the orientations shown in the drawings. The orientations may be inverted, rotated, or otherwise changed, such that an upper portion is a lower portion, and vice versa, horizontal becomes vertical, and the like.

Variations and modifications of the foregoing are within the scope of the present invention. It is understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention. The claims are to be construed to include alternative embodiments to the extent permitted by the prior art.

Various features of the invention are set forth in the following claims.

The invention claimed is:

1. A backrest assembly for a wheelchair, the backrest assembly comprising:

a support plate pivotally connected to a seat, wherein said support plate is configured to be pivotally adjusted between upright and reclined positions with respect to the seat;

a slide plate slidably secured on a front surface of said support plate; and a link operatively connected to a drive bar on a rear surface of said support plate, wherein said slide plate is configured to slide over said support plate when said support plate is pivotally adjusted between the upright and reclined positions and wherein said drive bar operatively connects to a pivot arm on the front surface of said support plate.

2. The backrest assembly of claim 1, wherein said slide plate is slid down said support plate in the reclined position.

3. The backrest assembly of claim 1, further comprising a cushion secured to a front of said slide plate.

4. The backrest assembly of claim 1, wherein said support plate is a unitary piece integrally formed from aluminum.

5. The backrest assembly of claim 1, wherein said pivot arm operatively connects to said slide plate, wherein movement of said pivot arm causes said slide plate to slide over said support plate.

6. The backrest assembly of claim 1, further comprising a backrest adjustment assembly positioned below said support plate.

7. A power wheelchair comprising:

a support base having wheels;

a seat supported by said support base; and a backrest assembly configured to pivot between upright and reclined positions with respect to said seat, said backrest assembly comprising:

a support plate pivotally connected to said seat, wherein said support plate is configured to be pivotally adjusted between upright and reclined positions with respect to said seat;

a slide plate slidably secured on a front surface of said support plate; and a link connected to a drive bar on a rear surface of said support plate;

wherein said slide plate is configured to slide over said support plate when said support plate is pivotally adjusted between the upright and reclined positions, and wherein said drive bar operatively connects to a pivot arm on the front surface of said support plate.

8. The backrest assembly of claim 7, wherein said slide plate is slid down said support plate in the reclined position, and wherein said slide plate is slid up said support plate in the upright position.

9. The backrest assembly of claim 7, further comprising a cushion secured to a front of said slide plate.

10. The backrest assembly of claim 7, wherein said support plate is integrally formed from a single piece of metal.

11. The backrest assembly of claim 7, wherein said pivot arm operatively connects to said slide plate, wherein movement of said pivot arm causes said slide plate to slide over said support plate.

12. The backrest assembly of claim 7, further comprising a backrest adjustment assembly positioned below said support plate.

13. A power wheelchair comprising:

a support base having wheels;

a seat supported by said support base; and a backrest assembly configured to pivot between upright and reclined positions with respect to said seat, said backrest assembly comprising:

a unitary support plate pivotally connected to said seat, wherein said support plate is configured to be pivotally adjusted between upright and reclined positions with respect to said seat;

a slide plate slidably secured on a front surface of said support plate;

a cushion secured to a front of said slide plate;

a backrest adjustment assembly positioned below said support plate, said backrest adjustment assembly operatively connected to said support plate and said slide plate, and a link operatively connected to a drive bar on a rear surface of said support plate, wherein said slide plate is configured to slide over said support plate between the upright and reclined positions, wherein said slide plate is slid down said support plate in the reclined position, wherein said slide plate is slid up said support plate in the upright position, and wherein said drive bar operatively connects to a pivot arm on the front surface of said support plate.

14. The backrest assembly of claim 13, wherein said pivot arm operatively connects to said slide plate, wherein movement of said pivot arm causes said slide plate to slide over said support plate.

* * * * *